US012398888B2

(12) United States Patent
Xie et al.

(10) Patent No.: US 12,398,888 B2
(45) Date of Patent: Aug. 26, 2025

(54) COOKTOP, COOKTOP SYSTEM, CONTROL METHOD AND APPARATUS, AND STORAGE MEDIUM

(71) Applicant: BSH Hausgeräte GmbH, Munich (DE)

(72) Inventors: Tong Xie, Nanjing (CN); Mingzhi Wang, Nanjing (CN); Ye Lu, Nanjing (CN); Lei Zhang, Nanjing (CN)

(73) Assignee: BSH Hausgeräte GmbH, Munich (DE)

( * ) Notice: Subject to any disclaimer, the term of this patent is extended or adjusted under 35 U.S.C. 154(b) by 830 days.

(21) Appl. No.: 17/635,012

(22) PCT Filed: Aug. 25, 2020

(86) PCT No.: PCT/EP2020/073680
§ 371 (c)(1),
(2) Date: Feb. 14, 2022

(87) PCT Pub. No.: WO2021/037821
PCT Pub. Date: Mar. 4, 2021

(65) Prior Publication Data

US 2022/0290867 A1 Sep. 15, 2022

(30) Foreign Application Priority Data

Aug. 30, 2019 (CN) ..... 201910812254.6

(51) Int. Cl.
*F24C 7/08* (2006.01)
*F24C 3/12* (2006.01)

(52) U.S. Cl.
CPC ..... *F24C 7/087* (2013.01); *F24C 3/126* (2013.01); *F24C 7/083* (2013.01)

(58) Field of Classification Search
CPC ..... F24C 3/126; F24C 7/083; F24C 7/087
See application file for complete search history.

(56) References Cited

U.S. PATENT DOCUMENTS 4,443,590 A 4/1984 Kamatani
4,443,690 A * 4/1984 Payne ..... G05D 23/1917 219/486

(Continued)

FOREIGN PATENT DOCUMENTS

WO 2012019891 A1 2/2012

OTHER PUBLICATIONS

International Search Report PCT/EP2020/073680 dated Oct. 29, 2020.

*Primary Examiner* — Thien S Tran
(74) *Attorney, Agent, or Firm* — Michael E. Tschupp; Andre Pallapies; Brandon G. Braun

(57) ABSTRACT

A cooktop includes a power adjustment switch with power grades, a power detection apparatus, a control apparatus, and an adjustment apparatus. The power detection apparatus for detects a power grade to determine an operation period of the power grade and a power level corresponding to the power grade and outputting operation information including the operation period and the power level. The control apparatus calculates a first valid period based on the operation information, and determines whether the first valid period exceeds a first threshold period. When affirmative, the control apparatus outputs adjustment information for adjusting the power grade to reduce the power level. The adjustment apparatus adjusts the power grade based on the adjustment information to reduce the power level. The cooktop actively detects an operating status and adjusts a power grade, to avoid dry burning and potential safety risks.

23 Claims, 3 Drawing Sheets

(56) References Cited

U.S. PATENT DOCUMENTS

| | | | |
|---|---|---|---|
| 4,604,518 | A | 8/1986 | Payne |
| 2006/0231551 | A1 | 10/2006 | Ruther et al. |
| 2018/0010804 | A1 | 1/2018 | Bach |
| 2021/0037611 | A1 | 2/2021 | Luckhardt |

* cited by examiner

COOKTOP, COOKTOP SYSTEM, CONTROL METHOD AND APPARATUS, AND STORAGE MEDIUM

CROSS-REFERENCES TO RELATED APPLICATIONS

This application is the U.S. National Stage of International Application No. PCT/EP2020/073680, filed Aug. 25, 2020, which designated the United States and has been published as International Publication No. WO 2021/037821 A1 and which claims the priority of Chinese Patent Application, Ser. No. 20/191,081254.6, filed Aug. 30, 2019, pursuant to 35 U.S.C. 119(a)-(d).

The contents of International Application No. PCT/EP2020/073680 and Chinese Patent Application, Ser. No. 20/191,081254.6 are incorporated herein by reference in their entireties as if fully set forth herein.

BACKGROUND

Technical Field

The present invention relates to the field of kitchen utensils, and in particular, to a cooktop, a cooktop system, a control method and apparatus, and a storage medium.

Related Art

With the development of smart homes, cooktops in the market are increasingly intelligent, thereby greatly facilitating user operations.

However, a user needs to observe a cooktop in the prior art, and it is not possible to actively notify the user according to the operating status of the cooktop. The user may neglect to observe the cooktop in time. As a result, the cooktop operates for a long time unsupervised, causing increase to both power cost and gas cost and posing potential safety risks.

SUMMARY

The technical problem to be solved in embodiments of the present invention is potential safety risks posed when a cooktop is left unsupervised for a long time.

To solve the technical problem, an embodiment of the present invention provides a cooktop, including a power adjustment switch with power grades, and further including a power detection apparatus, a control apparatus, and an adjustment apparatus. The power detection apparatus is suitable for detecting a power grade to determine an operation period of the power grade and a power level corresponding to the power grade and outputting operation information including the operation period and the power level; the control apparatus includes a receiving module, a determination module, a computing module, and a first judgment module, where the receiving module is suitable for receiving the operation information, the determination module is suitable for determining a preset power level coefficient corresponding to the power level based on a preset correspondence between the power level and a power level coefficient, the computing module is suitable for multiplying the operation period by the preset power level coefficient to obtain a first valid period, and the first judgment module is suitable for determining whether the first valid period exceeds a first threshold period, and if yes, outputting adjustment information for adjusting the power grade to reduce the power level, where a second valid period obtained by multiplying a preset power level coefficient corresponding to an expected power grade after the adjustment by the operation period does not exceed first threshold period; and the adjustment apparatus is suitable for adjusting the power grade based on the adjustment information to reduce the power level.

Optionally, the adjustment information is adjustment information for switching off the power grade to reduce the power level to zero, and the adjustment apparatus is suitable for adjusting the power grade based on the adjustment information to reduce the power level to zero.

Optionally, the control apparatus further includes a second judgment module, suitable for determining whether the power grade is an off grade, and if yes, setting the operation period to zero.

Optionally, the first judgment module is suitable for determining whether the first valid period exceeds a second threshold period, and if yes, sending warning information, where the second threshold period is shorter than the first threshold period.

Optionally, the power detection apparatus is suitable for detecting the power grades after the power grade is switched on from an off grade last time to determine operation periods of the power grades and power levels corresponding to the power grades, and outputting operation information including the operation periods and the power levels; the receiving module is suitable for receiving the operation information including the operation periods and the power levels; the determination module is suitable for determining preset power level coefficients corresponding to the power levels based on preset correspondences between the power levels and the power level coefficients; and the computing module is suitable for multiplying the operation periods by the corresponding preset power level coefficients respectively and then adding results of the multiplication to obtain the first valid period.

Optionally, the cooktop further includes a communication apparatus, suitable for receiving the adjustment information, and sending notification information to a communication terminal by using a communication network, where the adjustment apparatus is suitable for receiving, by using the communication network, control information that is sent by the communication terminal based on the notification information and is used for adjusting the power grade to reduce the power level, and adjusting the power grade based on the control information to reduce the power level.

An embodiment of the present invention further provides a cooktop system, including the foregoing cooktop and a communication terminal, where the communication terminal is suitable for receiving the notification information sent by the communication apparatus by using a communication network, and sending, to the adjustment apparatus based on the notification information, the control information for adjusting the power grade to reduce the power level.

An embodiment of the present invention further provides a method for controlling a cooktop, the cooktop including a power adjustment switch with power grades, the method including: detecting a power grade to determine an operation period of the power grade and a power level corresponding to the power grade; determining a preset power level coefficient corresponding to the power level based on a preset correspondence between the power level and a power level coefficient, multiplying the operation period by the preset power level coefficient to obtain a first valid period, determining whether the first valid period exceeds a first threshold period, and if yes, outputting adjustment information for adjusting the power grade to reduce the power level, where a second valid period obtained by multiplying a preset power level coefficient corresponding to an expected power grade after the adjustment by the operation period does not exceed first threshold period; and adjusting the power grade based on the adjustment information to reduce the power level.

Optionally, the adjustment information includes adjustment information for switching off the power grade to reduce the power level to zero, and the adjusting the power grade based on the adjustment information to reduce the power level includes adjusting the power grade based on the adjustment information to reduce the power level to zero.

Optionally, the method includes: determining whether the power grade is an off grade, and if yes, setting the operation period to zero.

Optionally, the method includes: determining whether the first valid period exceeds a second threshold period, and if yes, sending warning information, where the second threshold period is shorter than the first threshold period.

Optionally, the detecting a power grade to determine an operation period of the power grade and a power level corresponding to the power grade includes: detecting the power grades after the power grade is switched on from an off grade last time to determine operation periods of the power grades and power levels corresponding to the power grades; the determining a preset power level coefficient corresponding to the power level based on a preset correspondence between the power level and a power level coefficient includes: determining preset power level coefficients corresponding to the power levels based on preset correspondences between the power levels and the power level coefficients; and the multiplying the operation period by the preset power level coefficient to obtain a first valid period includes: multiplying the operation periods by the corresponding preset power level coefficients respectively and then adding results of the multiplication to obtain the first valid period.

Optionally, the adjusting the power grade based on the adjustment information to reduce the power level includes: sending, to a communication terminal by using a communication network, notification information related to the adjustment information; receiving control information that is sent by the communication terminal based on the notification information and is used for adjusting the power grade to reduce the power level; and adjusting the power grade based on the control information to reduce the power level.

An embodiment of the present invention further provides another method for controlling a cooktop, the cooktop including a power adjustment switch with power grades, the method including: receiving operation information that is outputted by a power detection apparatus of the cooktop and includes an operation period and a power level, where the power detection apparatus is suitable for detecting a power grade to determine the operation period of the power grade and the power level corresponding to the power grade; determining a preset power level coefficient corresponding to the power level based on a preset correspondence between the power level and a power level coefficient; multiplying the operation period by the preset power level coefficient to obtain a first valid period; and determining whether the first valid period exceeds a first threshold period, and if yes, outputting adjustment information for adjusting the power grade to reduce the power level, where a second valid period obtained by multiplying a preset power level coefficient corresponding to an expected power grade after the adjustment by the operation period does not exceed first threshold period.

Optionally, the adjustment information includes adjustment information for switching off the power grade to reduce the power level to zero.

Optionally, the method includes: determining whether the power grade is an off grade, and if yes, setting the operation period to zero.

Optionally, the method includes: determining whether the first valid period exceeds a second threshold period, and if yes, sending warning information, where the second threshold period is shorter than the first threshold period.

Optionally, the receiving operation information that is outputted by a power detection apparatus of the cooktop and includes an operation period and a power level of a power grade includes: receiving operation information including operation periods and power levels, where the power detection apparatus is suitable for detecting the power grades after the power grade is switched on from an off grade last time to determine the operation periods of the power grades and the power levels corresponding to the power grades, and outputting the operation information including the operation periods and the power levels; the determining a preset power level coefficient corresponding to the power level based on a preset correspondence between the power level and a power level coefficient includes: determining preset power level coefficients corresponding to the power levels based on preset correspondences between the power levels and the power level coefficients; and the multiplying the operation period by the preset power level coefficient to obtain a first valid period includes: multiplying the operation periods by the corresponding preset power level coefficients respectively and then adding results of the multiplication to obtain the first valid period.

An embodiment of the present invention further provides a control apparatus for controlling a cooktop, the cooktop including a power adjustment switch with power grades, the apparatus including: a receiving module, suitable for receiving operation information that is outputted by a power detection apparatus of the cooktop and includes an operation period and a power level, where the power detection apparatus is suitable for detecting a power grade to determine the operation period of the power grade and the power level corresponding to the power grade; a determination module, suitable for determining a preset power level coefficient corresponding to the power level based on a preset correspondence between the power level and a power level coefficient; a computing module, suitable for multiplying the operation period by the preset power level coefficient to obtain a first valid period; and a first judgment module, suitable for determining whether the first valid period exceeds a first threshold period, and if yes, outputting adjustment information for adjusting the power grade to reduce the power level, where a second valid period obtained by multiplying a preset power level coefficient corresponding to an expected power grade after the adjustment by the operation period does not exceed first threshold period.

Optionally, the adjustment information includes adjustment information for switching off the power grade to reduce the power level to zero.

Optionally, the control apparatus further includes a second judgment module, suitable for determining whether the power grade is an off grade, and if yes, setting the operation period to zero.

Optionally, the first judgment module is suitable for determining whether the first valid period exceeds a second threshold period, and if yes, sending warning information, where the second threshold period is shorter than the first threshold period.

Optionally, the receiving module is suitable for receiving operation information including operation periods and power levels, where the power detection apparatus is suitable for detecting the power grades after the power grade is switched on from an off grade last time to determine the operation periods of the power grades and the power levels corresponding to the power grades, and outputting the operation information including the operation periods and the power levels; the determination module is suitable for determining preset power level coefficients corresponding to the power levels based on preset correspondences between the power levels and the power level coefficients; and the computing module is suitable for multiplying the operation periods by the corresponding preset power level coefficients respectively and then adding results of the multiplication to obtain the first valid period.

An embodiment of the present invention further provides a storage medium, storing a computer instruction, where the computer instruction is executed to perform the steps of the another method for controlling a cooktop.

An embodiment of the present invention further provides a device for controlling a cooktop, including a memory and a processor, the memory storing a computer instruction executable by the processor, where the computer instruction is executed to perform the steps of the another method for controlling a cooktop.

Compared with the prior art, the embodiments in the present invention have beneficial effects. For example, the cooktop provided in the technical solutions of the present invention includes a power detection apparatus, a control apparatus, and an adjustment apparatus. Compared with that a user needs to observe the operating status of a cooktop in the prior art, in the technical solutions of the present invention, the cooktop actively detects an operating status and actively provides adjustment information for adjusting a power grade, to avoid dry burning and potential safety risks.

DETAILED DESCRIPTION

To make the objectives, features, and beneficial effects of the embodiments of the present invention more comprehensible, the following describes the embodiments of the present invention in detail with reference to the accompanying drawings.

Figure 1:
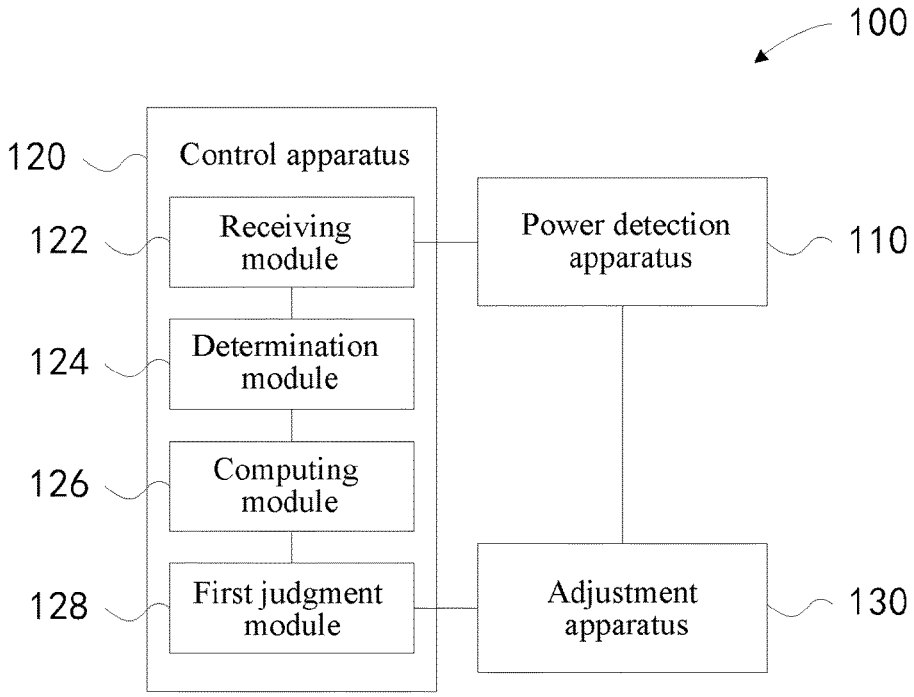
FIG. 1 is a schematic structural diagram of a cooktop according to an embodiment of the present invention.

FIG. 1 is a schematic structural diagram of a cooktop according to an embodiment of the present invention. A cooktop 100 includes a power detection apparatus 110, a control apparatus 120, and an adjustment apparatus 130.

The cooktop 100 includes a gas cooktop, an electric cooktop, and the like. The gas cooktop is a cooktop that converts chemical energy of gas into thermal energy, and includes a liquefied petroleum gas cooktop, a natural gas cooktop, a manufactured gas cooktop, and the like. The electric cooktop is a cooktop that converts electric energy into thermal energy, and includes an electromagnetic heating cooktop, an electric heating cooktop, a microwave heating cooktop, and the like. The cooktop 100 includes a power adjustment switch with power grades. The power adjustment switch usually has two or more power grades. The power adjustment switch adjusts the power grades to control a gas volume or an electric quantity, to further control a thermal energy level (also referred to as a power level) of the cooktop.

The power detection apparatus 110 is suitable for detecting a power grade to determine an operation period of the power grade and a power level corresponding to the power grade and outputting operation information including the operation period and the power level. Specifically, the power detection apparatus 110 may determine the operation period and the power level of the power grade by using detection methods such as sensing by using a sensor disposed near the power grade or querying a related software module of the power grade, and output the operation information. In an embodiment, the power detection apparatus 110 senses the location of the power grade by using the sensor disposed near the power grade, so that the operation period during which the cooktop is at the power grade and the power level corresponding to the power grade are determined.

The control apparatus 120 includes a receiving module 122, a determination module 124, a computing module 126, and a first judgment module 128. The receiving module 122 receives the operation information that is outputted by the power detection apparatus 110 and includes the operation period and the power level. The determination module 124 searches, according to received power level information, a correspondence table stored in a storage apparatus inside or outside the control apparatus 120, to determine a preset power level coefficient corresponding to the received power level, where all power levels and power level coefficients corresponding to the power levels are preset in the correspondence table. The computing module 126 multiplies the operation period by the determined preset power level coefficient to obtain a first valid period. The "multiplication" herein includes an operation of value multiplication and an operation of matrix multiplication (that is, an operation of multiplying elements of a matrix with only one row by corresponding elements of a matrix with only one column respectively and then adding results of the multiplication). The first judgment module 128 determines whether the first valid period exceeds a first threshold period, and if yes, outputs adjustment information for adjusting the power grade to reduce the power level, where the power grade needs to be adjusted to a new grade, and a second valid period obtained by multiplying a preset power level coefficient corresponding to the new grade by the operation period does not exceed the first threshold period.

In an embodiment, the correspondence table presets 10 power levels and corresponding preset power level coefficients. A preset power level coefficient corresponding to a level 0 (or referred to as an off grade of the power grade) is 0. A preset power level coefficient corresponding to a level 1 to a level 3 is 0.3. A preset power level coefficient corresponding to a level 4 to a level 6 is 0.6. A preset power level coefficient corresponding to a level 7 to a level 9 is 1. The first threshold period is 30 minutes. The determination module 124 searches the correspondence table to determine the preset power level coefficient corresponding to the received power level. The computing module 126 multiplies the operation period of the power grade by the determined corresponding preset power level coefficient to obtain the first valid period. The first judgment module 128 determines whether the first valid period exceeds the first threshold period (in this embodiment, the first threshold period is 30 minutes), and if yes, calculates an expected power grade after adjustment (the second valid period obtained by multiplying a preset power level coefficient corresponding to the expected power grade after adjustment by the operation period does not exceed the first threshold period), and then outputs the adjustment information for performing adjustment to the expected power grade to reduce the power level.

In another embodiment, the control apparatus 120 further includes a second judgment module, suitable for determining whether the power grade is an off grade, and at any time, if it is determined that the power grade is the off grade (including that a user manually sets the power grade to the off grade and that a cooktop automatically sets the power grade to the off grade), initializing the operation information to set the received operation period to zero and set the power level to null.

In another embodiment, the first judgment module 128 is suitable for determining whether the first valid period exceeds a second threshold period, and if yes, sending warning information, where the second threshold period is shorter than the first threshold period. Specifically, when the first threshold period is reached, the cooktop is at an alarm moment at which the grade needs to be adjusted. Before the alarm moment is reached, the cooktop sends the warning information to a user close to or far away from the cooktop, so that the user has a sufficient anticipation time and preparation time.

In another embodiment, since the power grade is switched on from the off grade last time, the power grade may be manually or automatically adjusted in sequence to a plurality of power grades (all the power grades are not the off grade), and the power detection apparatus 110 detects the power grades to determine operation periods of the power grades and power levels corresponding to the power grades, and outputs operation information including the operation periods and the power levels. The receiving module 122 receives the operation information that is outputted by the power detection apparatus 110 and includes the operation periods and the power levels. The determination module 124 determines preset power level coefficients corresponding to the power levels based on preset correspondences between the power levels and the power level coefficients; and searches, according to the received power level information, the correspondence table stored in the storage apparatus inside or outside the control apparatus 120, to determine the preset power level coefficients corresponding to the received power levels, where all power levels and power level coefficients corresponding to the power levels are preset in the correspondence table. The computing module 126 multiplies the operation periods by the corresponding preset power level coefficients respectively and then adding results of the multiplication to obtain the first valid period (that is, the foregoing "operation of matrix multiplication").

The adjustment apparatus 130 is suitable for adjusting the power grade based on the adjustment information to reduce the power level.

In an embodiment, the first judgment module 128 outputs the adjustment information, and the adjustment apparatus 130 automatically adjusts the power grade to the expected power grade based on the adjustment information directly. The operation avoids non-real-time and imprecise adjustments caused by manual operations, thereby meeting the requirement of urgently eliminating potential safety risks when the cooktop is left unsupervised for a long time.

In another embodiment, the first judgment module 128 outputs the adjustment information. The adjustment information is packaged and sent to a communication terminal 200 (referring to FIG. 2). The communication terminal 200 outputs control information based on the adjustment information. The adjustment apparatus 130 adjusts the power grade to the expected power grade based on the control information (based on the adjustment information indirectly).

In another embodiment, the adjustment apparatus 130 is an actuator that acquires, based on the adjustment information outputted by the control apparatus 120, the expected power grade after adjustment, and further adjusts the power grade to the expected power grade to reduce the power level.

In another embodiment, the adjustment information is adjustment information for switching off the power grade to reduce the power level to zero, and the adjustment apparatus 130 adjusts the power grade based on the adjustment information to reduce the power level to zero.

The cooktop 100 may further include a communication apparatus, suitable for receiving the adjustment information outputted by the first judgment module 128, packaging the adjustment information as notification information, and sending the notification information to the communication terminal 200 by using a communication network. The communication terminal 200 receives the notification information, and sends, to the adjustment apparatus based on the notification information, the control information for adjusting the power grade to reduce the power level. The adjustment apparatus is suitable for receiving the control information by using the communication network, and adjusting the power grade based on the control information to reduce the power level.

Specifically, the communication terminal 200 receives the notification information by using a program such as a pre-installe or browser, and generates prompt information to prompt a user by using a text, sound and/or vibration. After determining the expected power grade, the communication terminal 200 generates, by using the program such as the APP or the browser, the control information for adjusting the power grade to the expected power grade to reduce the power level. In an embodiment, after the user receives the prompt information, the expected power grade provided by the cooktop 10 is determined in the program. In another embodiment, after the user receives the prompt information, the power grade expected by the user is inputted in the program. In another embodiment, the program includes an automatic response module. After the automatic response module determines that a syntax format of the notification information is correct, the expected power grade provided by the cooktop 10 is automatically determined, thereby avoiding non-real-time and imprecise adjustments caused by manual operations.

In the technical solutions of the present invention, the communication terminal 200 includes a fixed terminal such as a personal computer and a mobile terminal such as a mobile phone and an IPAD. The communication network includes a fixed network such as an Ethernet and a fiber-optic network and a mobile network such as a 4G network and a WiFi network.

Figure 2:
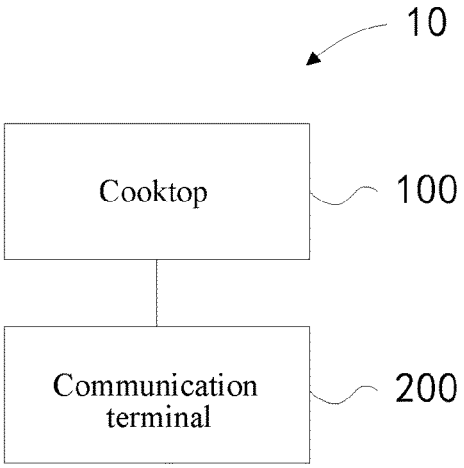
FIG. 2 is a schematic structural diagram of a cooktop system according to an embodiment of the present invention.

FIG. 2 is a schematic structural diagram of a cooktop system 10 according to an embodiment of the present invention. The cooktop system 10 includes the foregoing cooktop 100 and communication terminal 200.

Figure 3:
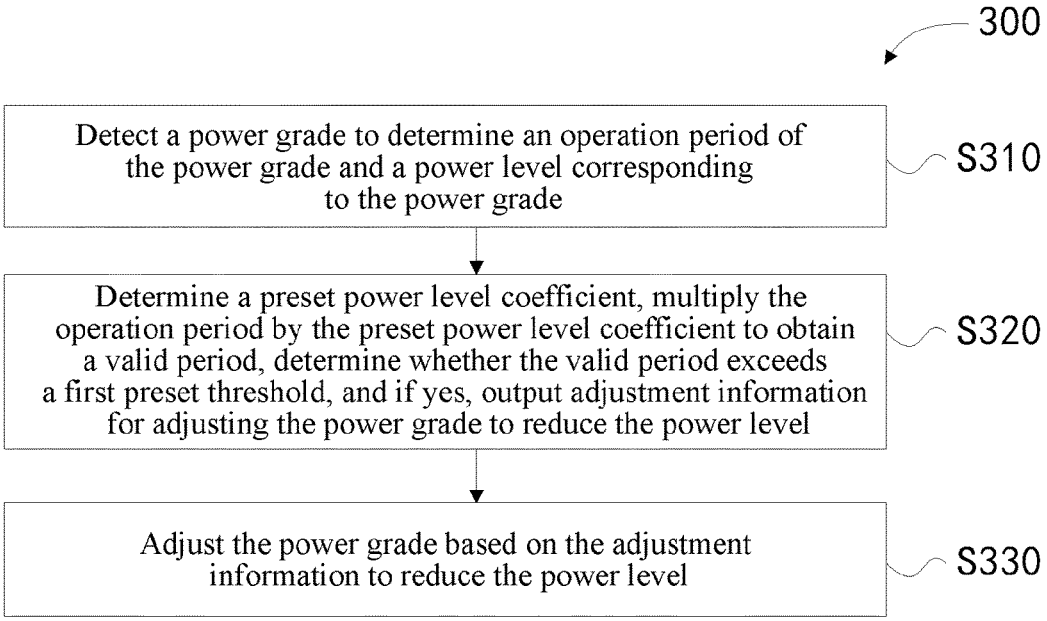
FIG. 3 is a schematic diagram of a method for controlling a cooktop according to an embodiment of the present invention.

FIG. 3 is a schematic diagram of a method 300 for controlling a cooktop according to an embodiment of the present invention. The method 300 includes the following steps:

Step S310: Detect a power grade to determine an operation period of the power grade and a power level corresponding to the power grade.

Step S320: Determine a preset power level coefficient corresponding to the power level based on a preset correspondence between the power level and a power level coefficient, multiply the operation period by the preset power level coefficient to obtain a first valid period, determine whether the first valid period exceeds a first threshold period, and if yes, output adjustment information for adjusting the power grade to reduce the power level, where a second valid period obtained by multiplying a preset power level coefficient corresponding to an expected power grade after the adjustment by the operation period does not exceed first threshold period.

Step S330: Adjust the power grade based on the adjustment information to reduce the power level.

In an embodiment, at any moment during the execution of the method 300, if it is determined that the power grade is an off grade (including that a user manually sets the power grade to the off grade and that a cooktop automatically sets the power grade to the off grade), the operation information is initialized to set the received operation period to zero and set the power level to null.

In another embodiment, step S310 includes: detecting the power grades after the power grade is switched on from an off grade last time to determine the operation periods of the power grades and the power levels corresponding to the power grades; and step S320 includes: determining preset power level coefficients corresponding to the power levels based on preset correspondences between the power levels and the power level coefficients, and multiplying the operation periods by the corresponding preset power level coefficients respectively and then adding results of the multiplication to obtain the first valid period.

In another embodiment, the adjustment information outputted in step S320 includes adjustment information for switching off the power grade to reduce the power level to zero, and step S330 includes adjusting the power grade based on the adjustment information to reduce the power level to zero.

During the execution of step S320, it may be determined whether the first valid period exceeds a second threshold period, and if yes, warning information is sent, where the second threshold period is shorter than the first threshold period.

During the execution of step S330, notification information related to the adjustment information may be sent to a communication terminal by using a communication network; control information that is sent by the communication terminal based on the notification information and is used for adjusting the power grade to reduce the power level is received; and the power grade is adjusted based on the control information to reduce the power level.

During specific implementation, for the related steps and elements involved in the method 300 for controlling a cooktop, reference may be made to the description of the cooktop 100 according to the embodiments of the present invention. Details are not described herein again.

Figure 4:
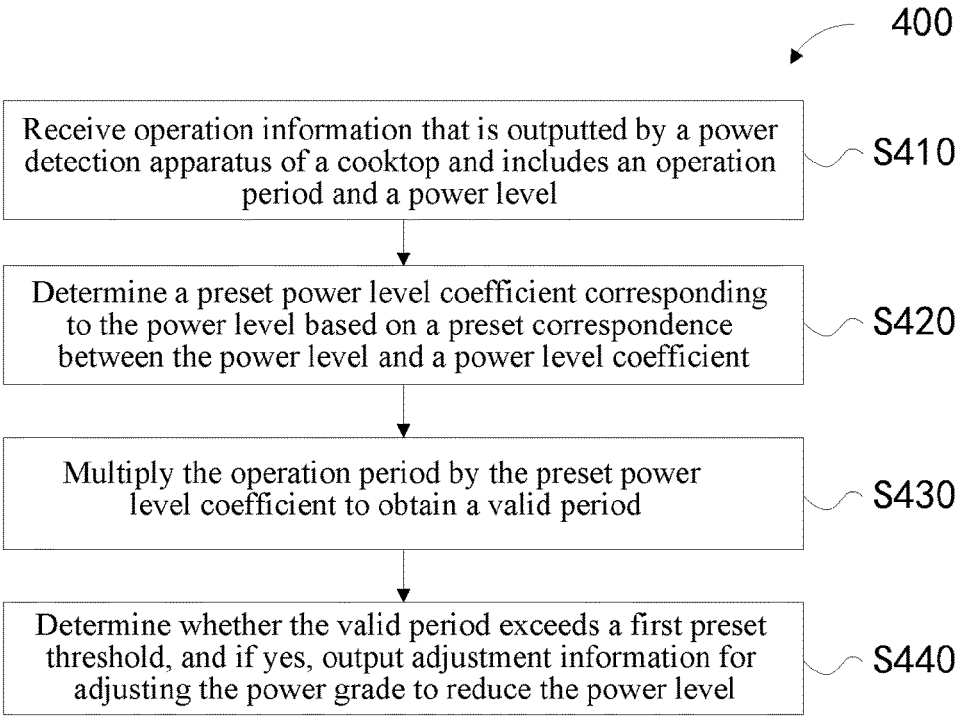
FIG. 4 is schematic diagram of another method for controlling a cooktop according to an embodiment of the present invention.

FIG. 4 is a schematic diagram of another method 400 for controlling a cooktop according to an embodiment of the present invention. The method 400 includes the following steps:

Step S410: Receive operation information that is outputted by a power detection apparatus of a cooktop and includes an operation period and a power level, where the power detection apparatus is suitable for detecting a power grade to determine the operation period of the power grade and the power level corresponding to the power grade.

Step S420: Determine a preset power level coefficient corresponding to the power level based on a preset correspondence between the power level and a power level coefficient.

Step S430: Multiply the operation period by the preset power level coefficient to obtain a first valid period.

Step S440: Determine whether the first valid period exceeds a first threshold period, and if yes, output adjustment information for adjusting the power grade to reduce the power level, where a second valid period obtained by multiplying a preset power level coefficient corresponding to an expected power grade after the adjustment by the operation period does not exceed first threshold period.

In an embodiment, at any moment during the execution of the method 400, if it is determined that the power grade is an off grade (including that a user manually sets the power grade to the off grade and that a cooktop automatically sets the power grade to the off grade), the operation information is initialized to set the received operation period to zero and set the power level to null.

In another embodiment, S410 includes: receiving operation information including operation periods and power levels, where the power detection apparatus is suitable for detecting the power grades after the power grade is switched on from an off grade last time to determine the operation periods of the power grades and the power levels corresponding to the power grades, and outputting the operation information including the operation periods and the power levels; S420 includes: determining preset power level coefficients corresponding to the power levels based on preset correspondences between the power levels and the power level coefficients; and S430 includes: multiplying the operation periods by the corresponding preset power level coefficients respectively and then adding results of the multiplication to obtain the first valid period.

During the execution of step S440, the outputted adjustment information includes adjustment information for switching off the power grade to reduce the power level to zero. In another embodiment, it is determined whether the first valid period exceeds a second threshold period, and if yes, warning information is set, where the second threshold period is shorter than the first threshold period.

During specific implementation, for the related steps and elements involved in the method 400 for controlling a cooktop, reference may be made to the description of the cooktop 100 according to the embodiments of the present invention. Details are not described herein again.

Figure 5:
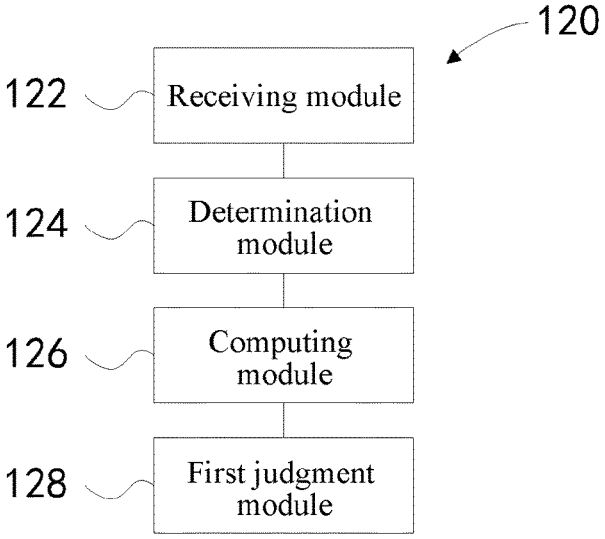
FIG. 5 is a schematic structural diagram of a control apparatus for controlling a cooktop according to an embodiment of the present invention.

FIG. 5 is a schematic structural diagram of a control apparatus 120 for controlling a cooktop according to an embodiment of the present invention. The control apparatus 120 includes a receiving module 122, a determination module 124, a computing module 126, and a first judgment module 128.

During specific implementation, for the control apparatus 120, reference may be made to the related description in a dust-removal device 100 according to an embodiment of the present invention. Details are not described herein again.

An embodiment of the present invention further provides a device configured in a cooktop, including a memory and a processor, the memory storing a computer instruction executable by the processor, where the computer instruction is executed to perform the steps of the another method 400 for controlling a cooktop.

An embodiment of the present invention further provides a storage medium, storing a computer instruction, where the computer instruction is executed to perform the steps of the another method 400 for controlling a cooktop.

Although the disclosure of the present invention is described above, the present invention is not limited thereto. A person skilled in the art may make various modifications and variations without departing from the spirit and scope of the present invention. Thus, the protection scope of the present invention should be subject to the scope defined by the claims.

What is claimed is:

1. A cooktop, comprising:

a power adjustment switch having a plurality of power grades;

a power detection apparatus configured to detect a power grade of the plurality of power grades to determine a power level corresponding to the power grade, and to determine an operation period of time that the cooktop is operated at the power level, said power detection apparatus outputting an operation information comprising the operation period and the power level;

a control apparatus comprising:

a receiving module configured to receive the operation information, a determination module configured to determine a first preset power level coefficient corresponding to the power level, a computing module configured to multiply the operation period by the first preset power level coefficient to obtain a first valid period, and a first judgment module configured to determine whether the first valid period exceeds a first threshold period, and in response to the first valid period exceeding the first threshold period, calculate and output an adjusted power grade to reduce the power level, wherein a second valid period obtained by multiplying a second preset power level coefficient corresponding to the adjusted power grade by the operation period does not exceed the first threshold period; and an adjustment apparatus configured to adjust the power grade to the adjusted power grade.

2. The cooktop of claim 1, wherein the adjusted power grade is configured to reduce the power level to zero.

3. The cooktop of claim 1, wherein the control apparatus comprises a second judgment module designed to determine whether the power grade is an off grade, and, when affirmative, to set the operation period to zero.

4. The cooktop of claim 1, wherein the first judgment module determines whether the first valid period exceeds a second threshold period, and when affirmative, sends a warning information, wherein the second threshold period is shorter than the first threshold period.

5. The cooktop of claim 1, wherein the power detection apparatus detects the power grade after the power grade is switched on from an off grade last time to determine operation periods of power grades and power levels corresponding to the power grades, and outputs an operation information comprising the operation periods and the power levels, said receiving module receiving the operation information comprising the operation periods and the power levels, and wherein the computing module multiplies the operation periods by the corresponding preset power level coefficients respectively and then adds results of the multiplication to obtain the first valid period.

6. A method for controlling a cooktop, the method comprising:

detecting a power grade of a power adjustment switch having a plurality of power grades to determine power level corresponding to the power grade, and to determine an operation period of time that the cooktop is operated at the power level;

determining a first preset power level coefficient corresponding to the power level;

multiplying the operation period by the first preset power level coefficient to obtain a first valid period;

determining whether the first valid period exceeds a first threshold period, and in response to the first valid period exceeding the first threshold period, calculate and output an adjusted power grade to reduce the power level, wherein a second valid period obtained by multiplying a second preset power level coefficient corresponding to the adjusted power grade by the operation period does not exceed first threshold period; and adjusting the power grade based on the adjusted power grade to reduce the power level.

7. The method of claim 6, wherein the adjusted power grade is configured to reduce the power level to zero.

8. The method of claim 6, further comprising determining whether the power grade is an off grade, and, when affirmative, setting the operation period to zero.

9. The method of claim 6, further comprising determining whether the first valid period exceeds a second threshold period, and, when affirmative, sending warning information, wherein the second threshold period is shorter than the first threshold period.

10. The method of claim 6, wherein the step of detecting the power grade comprises detecting the power grades after the power grade is switched on from an off grade last time to determine operation periods of the power grades and power levels corresponding to the power grades, and wherein the step of multiplying the operation period comprises multiplying the operation periods by the corresponding preset power level coefficients respectively and then adding results of the multiplication to obtain the first valid period.

11. The method of claim 6, wherein the step of adjusting the power grade comprises:

sending notification information comprising the adjusted power grade to a communication terminal via a communication network, using the notification information to provide a control information for adjusting the power grade to reduce the power level, and adjusting the power grade based on the control information to reduce the power level.

12. A method for controlling a cooktop, comprising the steps of:

receiving an operation information that is outputted by a power detection apparatus of the cooktop and comprises an operation period and a power level, with the power detection apparatus detecting a power grade of a power adjustment switch having a plurality of power grades to determine the power level corresponding to the power grade, and determine an operation period of time that the cooktop is operated at the power level determining a first preset power level coefficient corresponding to the power level;

multiplying the operation period by the first preset power level coefficient to obtain a first valid period; and determining whether the first valid period exceeds a first threshold period, and in response to the first valid period exceeding the first threshold period, calculate and output an adjusted power grade to reduce the power level, wherein a second valid period obtained by multiplying a second preset power level coefficient corresponding to the adjusted power grade by the operation period does not exceed first threshold period; and reducing the power grade to the adjusted power grade using an adjustment apparatus.

13. The method of claim 12, wherein the adjusted power grade is configured to reduce the power level to zero.

14. The method of claim 12, further comprising determining whether the power grade is an off grade, and, when affirmative, setting the operation period to zero.

15. The method of claim 12, further comprising determining whether the first valid period exceeds a second threshold period, and, when affirmative, sending warning information, wherein the second threshold period is shorter than the first threshold period.

16. The method of claim 12, wherein the step of receiving the operation information comprises receiving an operation information comprising operation periods and power levels, with the power detection apparatus detecting the power grades to determine operation periods of the power grades and power levels corresponding to the power grades after the power grade is switched on from an off grade last time and outputting the operation information comprising the operation periods and the power levels, and wherein the step of multiplying the operation period comprises multiplying the operation periods by the corresponding preset power level coefficients respectively and then adding results of the multiplication to obtain the first valid period.

17. A control apparatus for controlling a cooktop, comprising:

a receiving module designed configured to receive an operation information that is outputted by a power detection apparatus of the cooktop and comprises an operation period and a power level, with the power detection apparatus detecting a power grade of a power adjustment switch having a plurality of power grades to determine the level corresponding to the power grade, and to determine an operation period of time that the cooktop is operated at the power level;

a determination module configured to determine a first preset power level coefficient corresponding to the power level;

a computing module configured to multiply the operation period by the first preset power level coefficient to obtain a first valid period;

a first judgment module configured to determine whether the first valid period exceeds a first threshold period, and, in response to the first valid period exceeding the first threshold period, calculate and output an adjusted power grade to reduce the power level, wherein a second valid period obtained by multiplying a second preset power level coefficient corresponding to the adjusted power grade by the operation period does not exceed first threshold period; and reducing the power grade to the adjusted power grade with an adjustment apparatus.

18. The control apparatus of claim 17, wherein the adjusted power grade is configured to reduce the power level to zero.

19. The control apparatus of claim 17, further comprising a second judgment module designed to determine whether the power grade is an off grade, and when affirmative, setting the operation period to zero.

20. The control apparatus of claim 17, wherein the first judgment module determines whether the first valid period exceeds a second threshold period, and, when affirmative, sends a warning information, wherein the second threshold period is shorter than the first threshold period.

21. The control apparatus of claim 17, wherein the receiving module receives from the power detection apparatus an operation information comprising operation periods and power levels, with the power detection apparatus detecting the power grades after the power grade is switched on from an off grade last time to determine operation periods of the power grades and power levels corresponding to the power grades, and outputting the operation information comprising the operation periods and the power levels, and wherein the computing module multiplies the operation periods by the corresponding preset power level coefficients respectively and then adds results of the multiplication to obtain the first valid period.

22. A computer-readable, non-transitory storage medium storing a computer instruction to cause a processor to perform a method as set forth in claim 12.

23. A device for controlling a cooktop, comprising:

a processor; and a memory storing a computer instruction executable by the processor, wherein the computer instruction when loaded into the processor and executed by the processor, causes the processor to perform a method as set forth in claim 12.

* * * * *